United States Patent [19]

Josefek

[11] Patent Number: 4,773,107

[45] Date of Patent: Sep. 27, 1988

[54] CONTOURED PILLOW

[76] Inventor: Kirt L. Josefek, 344 Union Ave., Framingham, Mass. 01701

[21] Appl. No.: 72,983

[22] Filed: Jul. 13, 1987

[51] Int. Cl.[4] ..... A47C 20/02

[52] U.S. Cl. ..... 5/434; 5/436; 5/464

[58] Field of Search ..... 5/434–437, 5/442, 446, 464

[56] References Cited

U.S. PATENT DOCUMENTS

| | | | |
|---|---|---|---|
| 1,742,186 | 1/1930 | Claus | 5/464 X |
| 3,521,310 | 7/1970 | Greenawalt | 5/436 |
| 4,494,261 | 1/1985 | Morrow | 5/434 X |
| 4,550,458 | 11/1985 | Fiore | 5/434 |

FOREIGN PATENT DOCUMENTS

| | | | |
|---|---|---|---|
| 2915047 | 10/1980 | Fed. Rep. of Germany | 5/436 |
| 1199533 | 7/1970 | United Kingdom | 5/435 |

*Primary Examiner*—Michael F. Trettel
*Attorney, Agent, or Firm*—Joseph S. Iandiorio

[57] ABSTRACT

A contoured pillow including a first pillow section that has a central portion for supporting the rear of a person's neck in the supine position. A pair of side portions extend from the central portion and gradually increase in width toward opposite sides of the pillow for supporting the sides of the head and neck when turned toward respective sides of the pillow.

15 Claims, 3 Drawing Sheets

CONTOURED PILLOW

FIELD OF INVENTION

This invention relates to a contoured pillow and more particularly to a pillow which provides different degrees of head and neck support in the supine position and with the head turned to one side.

BACKGROUND OF INVENTION

The rear of the skull is large and protruding. As a result, when the head is placed in the supine position on a conventional pillow the neck is often not adequately supported. Specifically, the neck remains somewhat elevated relative to the back of the skull and, as a result, the cervical region tends to sag.

Attempts to address this problem have most often taken the form of a cylindrical or tubular padding or pillow which generally mates with and supports the back of the neck while allowing the prominent portion of the skull to sink into the pillow or mattress. Although such devices may provide some relief in the back reclined or supine position they do not perform quite so well when the head is turned to the left or right. This is because the head does not protrude nearly as much from the neck on the sides as it does in the back. Accordingly, as the head is turned to one side the support provided to the side of the neck by the roll or tubular padding is not needed to prevent the neck from sagging and, in fact, causes the head to sag, thereby causing further discomfort.

SUMMARY OF INVENTION

It is therefore an object of this invention to provide a pillow which offers improved cervical support and comfort.

It is a further object of this invention to provide such a pillow which is effective both in the supine position and with the head turned to one side.

It is therefore an object of this invention to provide a pillow which is of uniform thickness but provides varying support for neck and head.

It is a further object of this invention to provide such a pillow which exhibits a constant thickness but varying Indention Force Deflection (IFD).

It is a further object of this invention to provide such a pillow which is relatively simple and inexpensive.

It is a further object of this invention to provide such a pillow which creates unique support matched to the person's head and neck.

This invention results from the realization that improved cervical support may be achieved by providing differential support to prevent both the neck from sagging in the supine position and the head from sagging when turned to the right or left, and from the further realization that such differential support may be achieved by a pillow which has a contoured Indention Load Deflection and has a relatively narrow central portion for mating with and supporting the back of the neck in the supine position and is gradually contoured to wider side portions for supporting the side of the neck and at least part of the head when turned.

This invention features a contoured pillow including a first pillow section which includes a central portion for supporting the rear of a person's neck in the supine position and a pair of side portions extending from the central portion and gradually increasing in width toward opposite sides of the pillow for supporting the sides of the neck and head when turned toward the respective sides of the pillow.

In a preferred embodiment, the first pillow section may include a substantially uniform I.F.D., for example, of approximately 14±3 to 20±3. The central and side portions may also include a substantially uniform thickness and may be integrally connected. The first pillow section may include a resilient material such as foam.

The contoured pillow may also include a second section which has a softer I.F.D. than that of the first section and which complementarily engages the first section for receiving the rear of the skull, at least in the supine position. The second pillow section may include a substantially uniform I.F.D. of approximately 9±3. It may also include a substantially uniform thickness and the first and second sections may be substantially the same thickness. The second pillow section may include a resilient material such as foam.

The first section may include a concave region and the second section may include a complementary convex region for mating with the concave region. The first section may enclose the second section which may be located centrally within the first section. The second section may include a rhomboidal shape and the first section may include a rectangular prism.

DISCLOSURE OF PREFERRED EMBODIMENT

Other objects, features and advantages will occur from the following description of a preferred embodiment and the accompanying drawings, in which.

Figure 1:
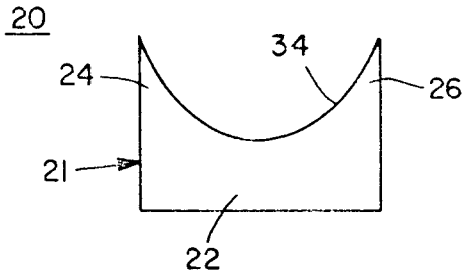
FIG. 1 is a plan view of a contoured pillow according to this invention.

An I.F.D. contoured pillow according to this invention is constructed with a first pillow section that includes a central portion and a pair of side portions which extend from the central portion and gradually increase in width toward opposite sides of the pillow. The central portion supportively engages the rear of a person's neck in the supine position and the side portions support the sides of the neck and head when turned toward the respective sides of the pillow. I.F.D. is the acronym for Indention Force Deflection, a property of foam and rubber material which characterizes its compressability under load and is recognized by the A.S.T.M. The I.F.D. differs from the density of the material of which the pillow sections are made. The I.F.D.s of the sections differ significantly, the density is typically the same or quite close. Typically the first pillow section includes a resilient material such as foam having a substantially uniform I.F.D. of approximately 14±3 to 20±3. The central and side portions are preferably integrally interconnected to form the first pillow section. They may also include a substantially uniform thickness of, for example, four inches so that the head and neck are comfortably supported in whatever position they are turned.

Preferably a second lower I.F.D. pillow section is complementarily engaged with the first pillow section in order to receive the rear of the skull, at least in the supine position. This section may also include a resilient material such as foam. The thickness of the second section is typically the same as that of the first pillow section, e.g., 4 inches. However, the I.F.D. is typically between approximately 9±3 thereby providing much softer support for accepting penetration of the rear of the skull.

In one embodiment, the first pillow section includes a concave region and the second section includes a complementary convex region which mates with the concave region of the first section. The pillow sections are attached by a suitable foam adhesive. Alternatively, the first section may fully enclose the second section. In such embodiments, the first section typically includes a rectangular prism and the second section is in the form of a rhomboidal element centrally located within the first section. The portion of the first section located between one of the rhomboidal vertexes and the outer surface of the pillow forms the central portion for supporting the neck in the region. The adjoining sides of the rhomboidal element recede from the outer surface of the first pillow section to define the side portions of the first pillow section.

Because the contoured pillow of this invention exhibits a uniform thickness but varying degrees of I.F.D. and support for the neck and head, both a very comfortable resting surface and improved neck support are achieved. Because the relatively more supportive first section increases gradually, and not abruptly, in width toward the sides of the pillows and the head is not blocked in the supine position, the head and neck are permitted to freely turn to either side without interference. At the same time improved differential support is provided for the head and neck, e.g., as the head gradually turns to one side, proportionally less of the protruding rear of the skull engages the pillow and more of the flatter side of the head and neck engage the pillow. Accordingly, to compensate for the loss of support provided by the rear of the head and maintain the turned head and neck at the elevation required to avoid sagging and resultant neck problems, the relatively more supportive side portions of the first section gradually widen to provide a degree of support for the head and neck which is commensurate with the degree to which the head is turned.

Figure 2:
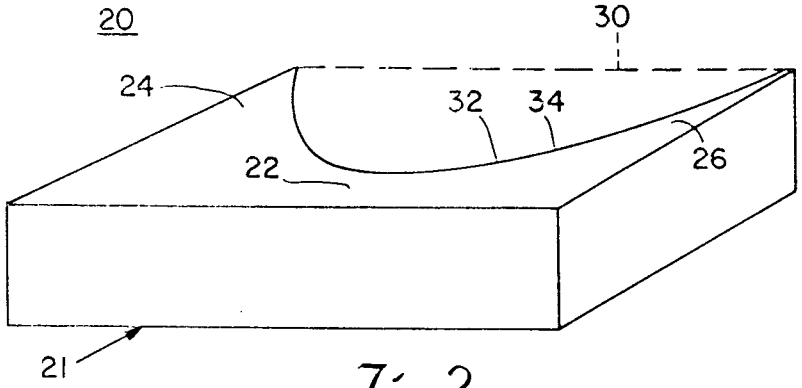
FIG. 2 is an enlarged axonometric view of the pillow of FIG. 1, employing a lower I.F.D. pillow section for accepting the rear of the skull.

An I.L.D. contoured pillow 20 according to this invention is shown in FIGS. 1 and 2. Pillow 20 is constructed from a single piece 21 of foam or other resilient material having an I.F.D. of approximately 14±3 to 20±3. The pillow has a relatively narrow central portion 22 and a pair of side portions 24 and 26 which gradually widen from central portion 22 toward opposite sides of pillow 20. As shown most clearly in FIG. 2, central portion 22 and side portions 24 and 26 have a uniform thickness of approximately four (4) inches.

A second pillow section 30, FIG. 2, may complementarily engage first pillow section 20. Pillow section 30 typically includes the same thickness as section 20 and has a convex surface 32 which mates with the complementary concave surface 34 of first section 20. Pillow section 30 is attached to pillow section 20 by any suitable adhesive. The convex pillow section 30 is constructed of a resilient material such as foam which is softer than that of pillow section 20. For example, section 30 may exhibit an I.F.D. of approximately 9±3.

Figure 3:
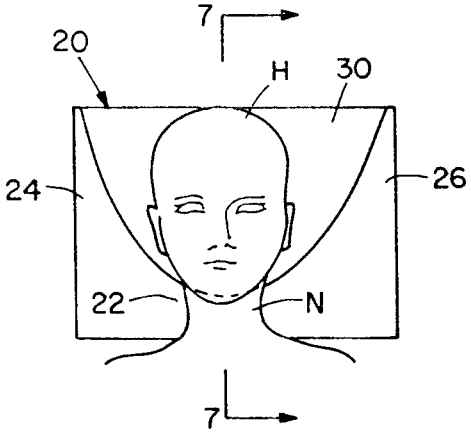
FIG. 3 is a plan view of the pillow of this invention being used to support the neck in the supine position.
Figure 5:
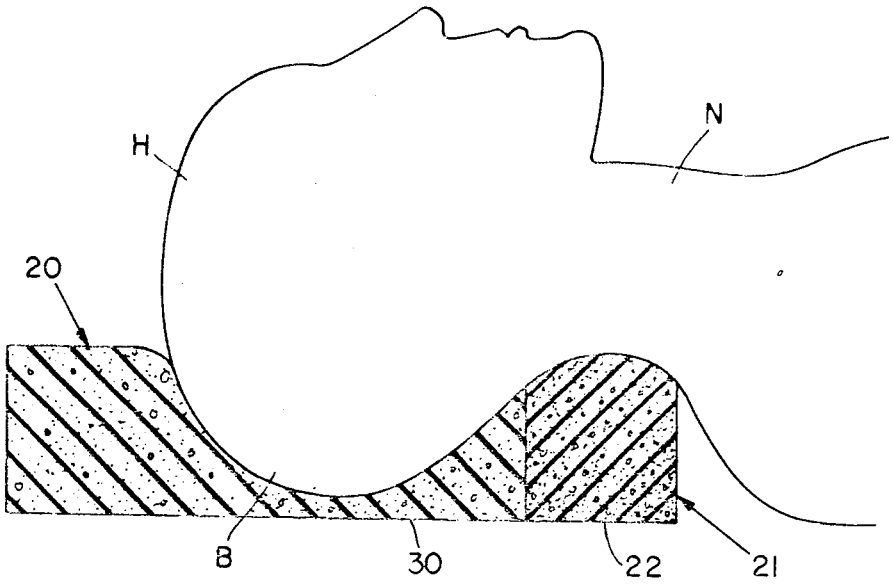
FIG. 5 is an elevational sectional view taken along line 5—5 of FIG. 3.

As shown in FIGS. 3 and 5, with the user in the supine position, bulge B of head H is received by softer second pillow section 30 so that neck N is elevated relative to the rear of the head. Central portion 22 of stiffer first section 20 fits against the back of neck N and helps to support the neck and maintain it in this elevated condition so that the cervical vertabrae therein do not sag and cause neck pain.

Figure 4:
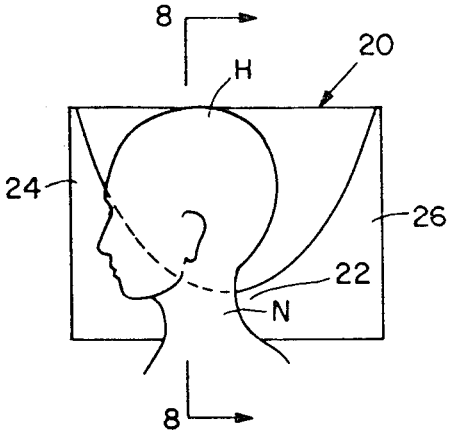
FIG. 4 is a plan view of the pillow supporting a head and neck turned to one side.
Figure 6:
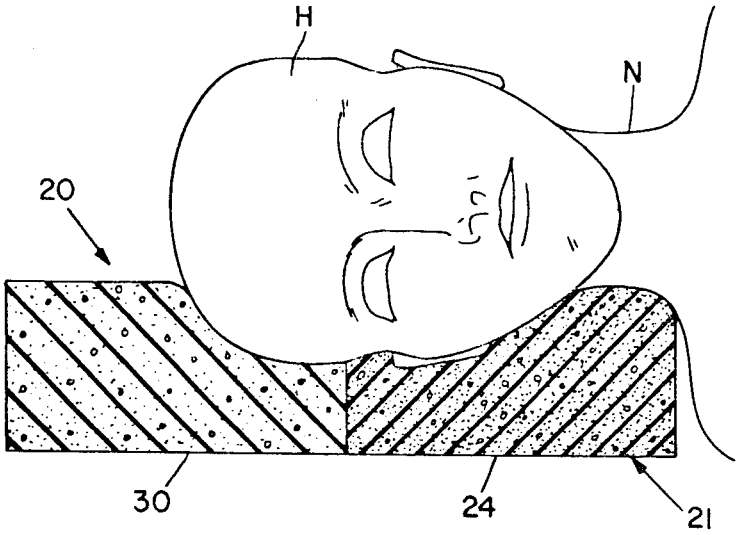
FIG. 6 is an elevational sectional view taken along line 6—6 of FIG. 4.

As the user turns his neck to one side, for example, toward the right as shown in FIGS. 4 and 6, the side of neck N and at least part of that of head H roll onto side portion 24 of relatively stiffer first pillow section 20. As a result, the support provided for head H is increased over that provided in the supine position. The soft support of section 30 is not sufficient against the side of the head because the side does not include prominent bulge B which is exhibited by the rear of the skull and which supports the head and neck at the desired elevation in the supine position. The increased support provided to the side of the head by stiffer side portion 24 prevents head H from sagging relative to neck N and greatly reduces uncomfortable bending of the cervical vertebrae.

Because the widths of side portions 24 and 26 increase gradually rather than suddenly toward the sides of pillow 20, a varying degree of support is provided for head H and neck N as they are turned to varying degrees to one side. As head H is turned to a greater degree toward one side, bulge B at the rear of head H provides less support and less elevation for neck N. Accordingly, the support provided by stiffer side portions 24, 26 increases proportionately to properly support the head and maintain the proper cervical alignment.

Figure 7:
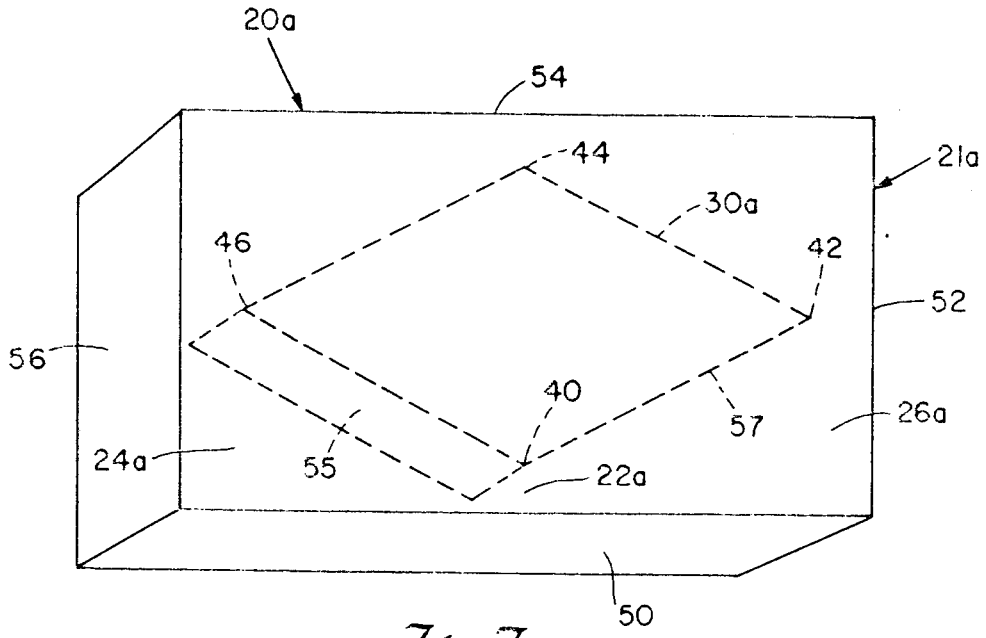
FIG. 7 is an axonometric view of an alternative I.F.D. contoured pillow according to this invention.
Figure 8:
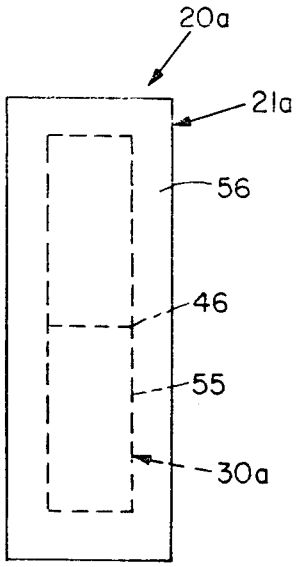
FIG. 8 is an elevational side view of the pillow of FIG. 7.

An alternative contoured pillow **20*a* according to this invention is shown in FIGS. 7 and 8. Pillow 20*a* includes an outer section 21*a* constructed in the shape of a rectangular prism and including foam or other resilient material having an I.F.D. of between approximately 14±3 and 20±3. Pillow section 21*a* encloses a second softer pillow section 30*a* which is located centrally within section 21*a*. Section 30*a* is composed of a resilient material such as foam having an I.F.D. of approximately 9±3. It includes a rhomboidal shape with vertexes 40, 42, 44 and 46 pointing toward respective sides 50, 52, 54 and 56 of outer pillow section 21*a***.

Figure 9:
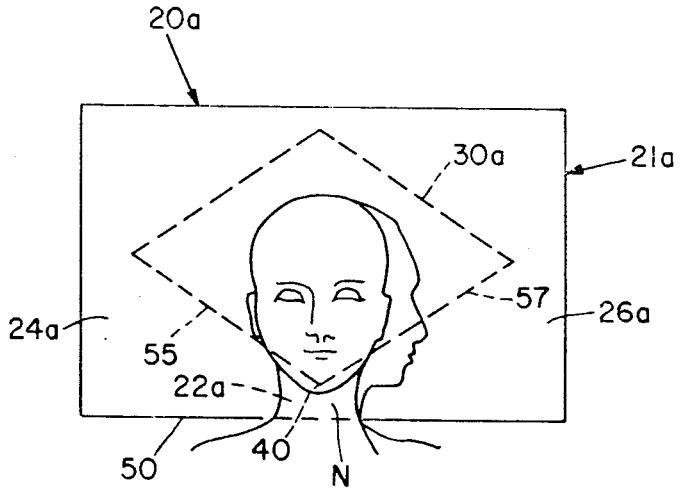
FIG. 9 is a plan view of a person's head and neck oriented in two different directions on the I.F.D. contoured pillow of FIG. 7.

As shown in FIGS. 7 and 9, outer pillow section **21*a* includes a central portion 22*a* generally between vertex 40 of inner pillow section 30*a* and side 50 of outer section 21*a*. The sides 55, 57 of rhomboidal inner section 30*a* recede from side 50 of outer section 21*a* so that the outer pillow section gradually widens into side portions 24*a* and 26*a*. With the user in the supine position, FIG. 9, head H is permitted to sink into pillow 20*a* by relatively soft inner pillow section 30*a*. As previously described, the bulge at the rear of the skull maintains the head and neck at a certain elevation and central portion 22*a* of pillow section 21*a*** mates with the back of neck and supports the neck so that it does not sag.

When head H turns, for example, to the left, the side of the head and neck engage the gradually widening side portion **26*a***. As a result, increased support is provided for the side of head H, which does not protrude quite so dramatically below neck N, so that the head does not sag and cause a discomforting bend in the neck.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A contoured pillow of uniform thickness comprising:

a first pillow section of substantially uniform thickness and having a first I.F.D., which includes a central portion for supporting the rear of a person's neck in the supine position, and a pair of side portions extending from said central portion and gradually increasing in width toward opposite sides of the pillow for supporting the sides of the neck and head when turned toward the respective sides of the pillow; and a second section of substantially uniform thickness, which has a lower I.F.D. than that of said first section and which complementarily engages said first section for receiving the rear of said head, at least in the supine position.

2. The contoured pillow of claim 1 in which said first pillow section includes a first substantially uniform I.F.D.

3. The contoured pillow of claim 1 in which said central portion and said side portions are integrally connected.

4. The contoured pillow of claim 1 in which said first pillow section has an I.F.D. of approximately 14 ±3 to 20 ±3.

5. The contoured pillow of claim 1 in which said first pillow section includes a resilient material.

6. The contoured pillow of claim 1 in which said first pillow section includes foam.

7. The contoured pillow of claim 1 in which said second pillow section includes a second substantially uniform I.L.D. which is softer than said first I.F.D. of said first section.

8. The contoured pillow of claim 1 in which said second pillow section includes a resilient material.

9. The contoured pillow of claim 1 in which said second pillow section includes an I.F.D. of approximately 9±3.

10. The contoured pillow of claim 1 in which said second pillow section includes foam.

11. The contoured pillow of claim 1 in which said first section includes a concave region and said second section includes a complementary convex region for mating with said concave region.

12. The contoured pillow of claim 1 in which said first section encloses said second section.

13. The contoured pillow of claim 1 in which said second section includes a rhomboidal shape.

14. The contoured pillow of claim 1 in which said first section includes a rectangular polyhedron.

15. The contoured pillow of claim 1 in which said second section is located centrally within said first section.

* * * * *